US010765221B2

(12) United States Patent
Ketels et al.

(10) Patent No.: US 10,765,221 B2
(45) Date of Patent: Sep. 8, 2020

(54) ORIGAMI ARMREST

(71) Applicant: Faurecia Automotive Seating, LLC, Auburn Hills, MI (US)

(72) Inventors: Cedric Ketels, Sunnyvale, CA (US); Christian Neyrinck, Stadthagen (DE); Rodney S. Goodrich, Watervliet, MI (US); Thomas Dessapt, Stadthagen (DE); Helene Chassaing, Hannover (DE); Robert Fitzpatrick, Holland, MI (US); Delphine Mace, Nozay (FR); Sascha Heiden, Stadthagen (DE)

(73) Assignee: FAURECIA AUTOMOTIVE SEATING, LLC, Auburn Hills, MI (US)

( * ) Notice: Subject to any disclaimer, the term of this patent is extended or adjusted under 35 U.S.C. 154(b) by 0 days.

(21) Appl. No.: 16/053,062

(22) Filed: Aug. 2, 2018

(65) Prior Publication Data

US 2020/0037771 A1 Feb. 6, 2020

(51) Int. Cl.

| | |
|---|---|
| ***A47C 16/00*** | (2006.01) |
| ***A47B 23/06*** | (2006.01) |
| ***A47B 23/00*** | (2006.01) |

(52) U.S. Cl.

CPC ..... *A47C 16/00* (2013.01); *A47B 23/002* (2013.01); *A47B 23/06* (2013.01)

(58) Field of Classification Search

CPC ..... A47C 16/00; A47B 23/002; A47B 23/06
USPC ..... 248/118–118.5, 174, 456, 459, 460; 312/162, 128
See application file for complete search history.

(56) References Cited

U.S. PATENT DOCUMENTS 2,071,394 A * 2/1937 Douglas ..... A24F 19/0028 229/400
4,991,812 A * 2/1991 MacEwan ..... A47B 19/08 248/174
5,370,346 A * 12/1994 Long ..... A47B 21/0371 248/118.5
5,678,800 A * 10/1997 Markussen ..... G06F 3/0395 248/346.01

(Continued)

FOREIGN PATENT DOCUMENTS

CN 204393898 U 6/2015
CN 205625332 U 10/2016

(Continued)

*Primary Examiner* — Muhammad Ijaz
(74) *Attorney, Agent, or Firm* — Reising Ethington P.C.

(57) ABSTRACT

A portable armrest is manually convertible between a deployed configuration and a folded configuration and includes a lap portion, an arm portion, and a support portion. The support portion vertically spaces the arm portion from the lap portion when the lap portion is positioned on the lap of a seated user with the armrest in a deployed configuration, and the weight of an extended arm of the user is transferred to the lap when the arm is rested on the arm portion. The armrest is formed as a segmented panel including a plurality of rigid segments interconnected into a unitary piece by flexible joints along the perimeter of each segment. The deployed armrest enables users to relax their extended arms while bringing a handheld device into viewing range without lowering their heads. The armrest can be folded into a small packaging space for portability.

20 Claims, 7 Drawing Sheets

(56) References Cited

U.S. PATENT DOCUMENTS

| | | | | | |
|---|---|---|---|---|---|
| 5,765,790 | A * | 6/1998 | Kuldvere | A47B 23/002 | 108/43 |
| 5,971,148 | A * | 10/1999 | Jackson | G06F 1/1628 | 108/43 |
| 8,424,829 | B2 * | 4/2013 | Lu | A45C 7/0036 | 248/152 |
| D708,838 | S * | 7/2014 | Lee | D14/440 | |
| 10,045,612 | B2 * | 8/2018 | Freeman, Jr. | A47B 21/0371 | |
| 2004/0084576 | A1 * | 5/2004 | Khan | A47B 21/0371 | 248/118 |
| 2009/0172884 | A1 * | 7/2009 | Semlitsch | A61G 13/1235 | 5/623 |
| 2011/0017105 | A1 * | 1/2011 | Valdivia | A47B 23/043 | 108/50.14 |
| 2011/0155022 | A1 * | 6/2011 | Rochel | A47B 23/00 | 108/25 |
| 2017/0215588 | A1 * | 8/2017 | Trucco | A47G 9/10 | |
| 2020/0037771 | A1 * | 2/2020 | Ketels | A47B 23/002 | |

FOREIGN PATENT DOCUMENTS

| | | | |
|---|---|---|---|
| KR | 20110007159 | U | 7/2011 |
| WO | WO2007000005 | A1 | 1/2007 |

* cited by examiner

ORIGAMI ARMREST

TECHNICAL FIELD

The present disclosure relates generally to human limb supports and, in particular, to portable limb supports.

BACKGROUND

Portable electronic devices such as smartphones and tablets are ubiquitous in the modern era. Most of these devices require both visual and tactile interaction, meaning that the user must be able to both see and touch the device in order to use it. Handheld electronic devices satisfy the tactile requirement by their nature—i.e., the devices are within reach while being held. This means that users must look toward their hands while using such a device, which has led to a variety of relatively new repetitive body motions and positions. Users must extend their arms forward and upward to be able to properly view the handheld device, and/or they must lower their gaze with their arms rested on their laps in a more relaxed position. The results of these body positions when held for prolonged periods may include arm and shoulder fatigue from arm extension, as well as hunched posture and neck fatigue from looking down toward the handheld device. Users in moving vehicles may experience motion sickness while looking down at a handheld device due in part to reduced peripheral vision of vehicle motion.

U.S. patent application publication 2009/0172884 by Semlitsch discloses an arm rest for positioning the arm of a medical patient in relation to an examination table, especially during a tomographic radioscopy examination or an operation. The arm rest includes a base plate that can be pushed under the patient, an inclined support plate extending from the base plate, and an elongated and inclined carrier element on the end of the supporting plate. The carrier element supports the arm of the patient above the examination table and uses the patient's weight to hold the arm rest in place. The arm rest is not portable and is configured for only one arm to be rested off to the side of the patient's body.

SUMMARY

In accordance with various embodiments, a portable armrest includes a lap portion, an arm portion, and a support portion. The support portion vertically spaces the arm portion from the lap portion when the lap portion is positioned on the lap of a seated user with the armrest in a deployed configuration. In the deployed configuration, the weight of an extended arm of the seated user is transferred to the lap when the arm is rested on the arm portion. The armrest is manually convertible between the deployed configuration and a folded configuration.

In some embodiments, the support portion includes an end wall and a pair of side walls. The end wall extends between an end of the lap portion and the arm portion, and the side walls extend from opposite ends of the end wall to form respective acute angles with the end wall in the deployed configuration.

In some embodiments, the armrest includes a segmented panel having a plurality of flat segments interconnected by hinge joints.

In some embodiments, flat segments of the armrest are arranged in a plurality of parallel planes and overlap each other in the folded configuration so that the portable armrest is flat when in the folded configuration.

In some embodiments, at least one hinge joint of the armrest is configured to provide 360 degrees of relative movement between adjacent flat segments of the armrest.

In some embodiments, at least one hinge joint of the armrest is non-linear so that relative movement between adjacent flat segments of the armrest about the non-linear joint is restricted to only a partial rotational degree of freedom.

In some embodiments, a non-linear hinge joint connects the arm portion to the support portion.

In some embodiments, the armrest includes a foldable connector connecting the lap portion to the support portion. The foldable connector is flat in the folded configuration and folded over on itself in the deployed configuration.

In some embodiments, the armrest includes a foldable connector connecting the arm portion to the support portion. The foldable connector is folded over on itself in the deployed configuration.

In some embodiments, the armrest includes a foldable connector connecting the support portion to the arm portion or to the lap portion via one or more hinge joints. The foldable connector includes a plurality of flat segments interconnected by additional hinge joints.

In some embodiments, a foldable connector of the armrest is folded in a first direction about one of the hinge joints in the deployed configuration and in an opposite second direction in the folded configuration.

In some embodiments, the armrest includes a reversible fastener that engages to couple the arm portion with the support portion in the deployed configuration and is disengaged in the folded configuration.

In some embodiments, the armrest includes an upholstery layer and a segmented layer. The segmented layer includes a plurality of rigid plates spaced apart from each other at fixed locations along the upholstery layer. Each of the rigid plates has an edge that runs parallel with an edge of an adjacent rigid plate along a gap. The upholstery layer spans the gap to at least partly define a hinge joint between the adjacent plates.

In some embodiments, the armrest includes a plurality of hinge joints. Each hinge joint is located along parallel edges of adjacent rigid plates of a segmented layer of the armrest. A first pair of adjacent plates is spaced apart a different amount than a second pair of adjacent plates so that widths of the respective hinge joints are different.

In some embodiments, the armrest includes an additional upholstery layer, and a segmented layer is disposed between upholstery layers. A hinge joint of the armrest includes a portion of both upholstery layers.

In some embodiments, the armrest includes a cushion layer disposed between a segmented layer an upholstery layer.

In some embodiments, a cushion layer of the armrest is segmented so that the cushion layer does not span a hinge joint of the armrest.

In some embodiments, the armrest includes an armrest accessory extending from the arm portion when the portable armrest is in the deployed configuration.

Various aspects, embodiments, examples, features and alternatives set forth in the preceding paragraphs, in the claims, and/or in the following description and drawings may be taken independently or in any combination thereof. For example, features disclosed in connection with one embodiment are applicable to all embodiments in the absence of incompatibility of features.

DESCRIPTION OF THE DRAWINGS

One or more embodiments will hereinafter be described in conjunction with the appended drawings, wherein like designations denote like elements, and wherein.

DETAILED DESCRIPTION OF EMBODIMENTS

The armrest described herein enables seated users to relax their extended arms and maintain an upright posture while bringing a handheld device or other item into viewing range. The armrest can also be folded into a small packaging space for portability and useful deployment in various different scenarios, such as in automobiles, passenger trains, or buses or while seated nearly anywhere. The armrest can have a one-piece unitary construction such that separate components do not have to be assembled together when deploying the armrest from its portable configuration. The one-piece construction can be in the form of a continuous and generally flat panel or sheet divided into segments by hinge joints. The joints allow the panel to be folded back on itself in a manner reminiscent of origami paper art, particularly when the segments are primarily triangular, giving the armrest a desirable aesthetic appeal and a compact and intuitive folding.

Figure 1:
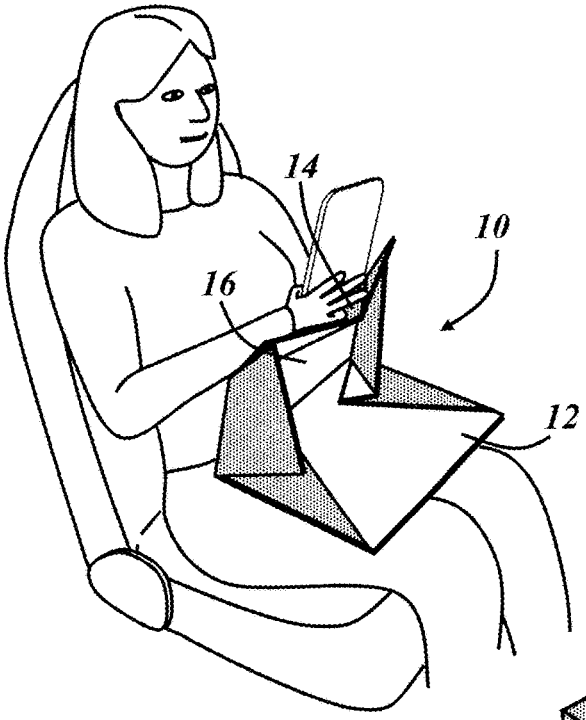
FIG. 1 depicts a seated user with an embodiment of a portable armrest in a deployed configuration positioned on her lap.

FIG. 1 depicts a seated user with an embodiment of a portable armrest 10 positioned on her lap. The armrest 10 includes a lap portion 12, an arm portion 14, and a support portion 16 extending between the lap and arm portions. The support portion 16 vertically spaces the arm portion 14 from the lap portion 12 when the lap portion is positioned on the lap of the seated user with the armrest 10 in the deployed condition, as shown in FIG. 1. When the user rests one or both extended arms on the arm portion 14 in this configuration, the weight of each arm is transferred to the lap. Unlike traditional armrests usually found off to the side of the seated user along the left and/or right side of a chair or other seat, the illustrated armrest 10 is configured to support the arms of the user toward the center of the body for a more direct line-of-sight to handheld objects. The armrest 10 is manually convertible between the deployed configuration and a folded configuration, as discussed further below.

Figure 2:
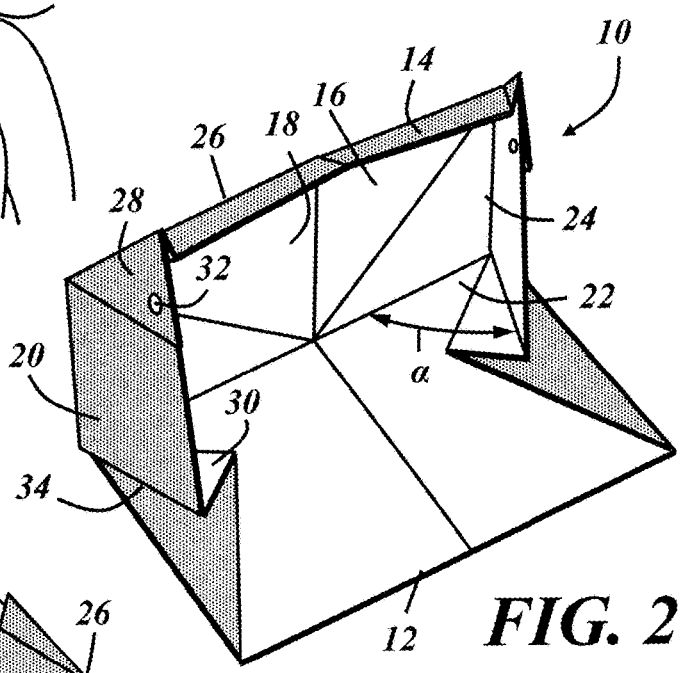
FIG. 2 is a perspective view of an embodiment of the portable armrest from a forward-facing side of the armrest.
Figure 3:
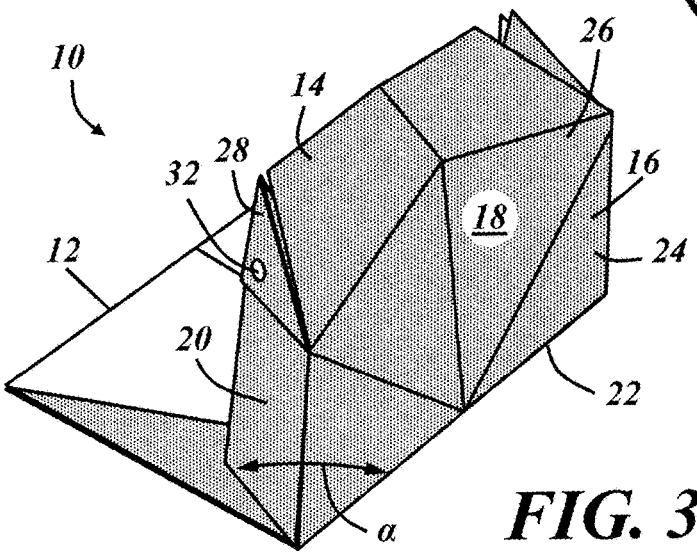
FIG. 3 is a perspective view of the portable armrest of FIG. 2 from a body-facing side of the armrest.

With reference to FIGS. 2 and 3, the support portion 16 of the illustrated armrest 10 includes an end wall 18 and a pair of side walls 20. The end wall 18 extends laterally along one longitudinal end 22 of the lap portion 12 and away from the end 22 of the lap portion to the arm portion 14. Each of the side walls 20 extends from one of the opposite lateral ends 24 of the end wall 18. When in the deployed configuration, the side walls 20 form respective acute angles $\alpha$ with the end wall 18 and are generally perpendicular to the lap portion 12, with the bottom of each end wall extending over and being supported by the lap portion 12.

The arm portion 14 extends laterally along an upper end 26 of the end wall 18 of the support portion 16 and away from the upper end 26 of the support portion in the same longitudinal direction as the lap portion 12 such that the arm portion 14 extends over the lap portion and is within the projected area of the lap portion. It is noted that directional terms such as lateral, longitudinal, vertical, top, bottom, upper, lower, etc. are used here in reference to the armrest 10 in its intended orientation of use. In this orientation of use, the lap portion 12 rests on the lap of the seated user, and the longitudinal end 22 of the lap portion from which the end wall 18 extends is the end of the lap portion that is nearest the torso of the seated user, as depicted in FIG. 1. In other words, if the seated user holds the deployed armrest upside-down or rotated to a different orientation than that depicted in FIG. 1, this does not change the portions of the armrest being referred to in this disclosure. FIG. 2 thus shows a forward-facing side of the deployed armrest 10, which faces away from the torso of the user, and FIG. 3 shows a body-facing side of the deployed armrest that faces the torso of the user.

The illustrated armrest 10 additionally includes upper and lower foldable connectors 28, 30 that facilitate convertibility between the deployed configuration and the folded configuration. Each connector 28, 30 is in a flat configuration when the armrest 10 is in the folded configuration, and each connector is folded when the armrest is in the deployed condition. When in use in the deployed configuration, the connectors 28, 30 also restrict relative movement of the lap, arm, and support portions 12-16.

In particular, the upper foldable connectors 28 connect the arm portion 14 to the side walls 20 of the support portion 16 and restrict relative movement between the side walls and the arm portion. Each upper foldable connector 28 extends from a lateral end of the arm portion 14 and wraps around an upper end of the respective side wall 20, thereby restricting downward movement of the arm portion relative to the support portion 16. A reversible fastener 32, such as a snap, magnet, or hook-and-loop fastener, may be included to reversibly couple the arm portion 14 with the support portion 16 via the foldable connector 28 in the deployed configuration, with the fastener disengaged in the folded configuration. The fasteners 32 further restrict movement of the arm portion 14 relative to the support portion 16, particularly in the vertical direction, which is the direction of applied load during use as an armrest.

The lower foldable connectors 30 connect the lap portion 12 to the side walls 20 of the support portion 16 and restrict relative movement between the side walls and the lap portion. Each lower foldable connector 30 extends from a lateral end of the lap portion 12 and from the bottom end of each side wall 20. In the deployed configuration, each lower foldable connector 30 is folded over on itself in the manner of an origami reverse fold. In particular, each foldable connector 30 is folded in a first direction about a hinge joint 34 between the connector 30 and the side wall 20 in the deployed configuration and in an opposite second direction when the armrest is in the folded configuration, as illustrated further below. The foldable connector 30 restricts horizontal movement of the side walls 20 relative to the lap portion 12 in the deployed configuration.

Figure 4:
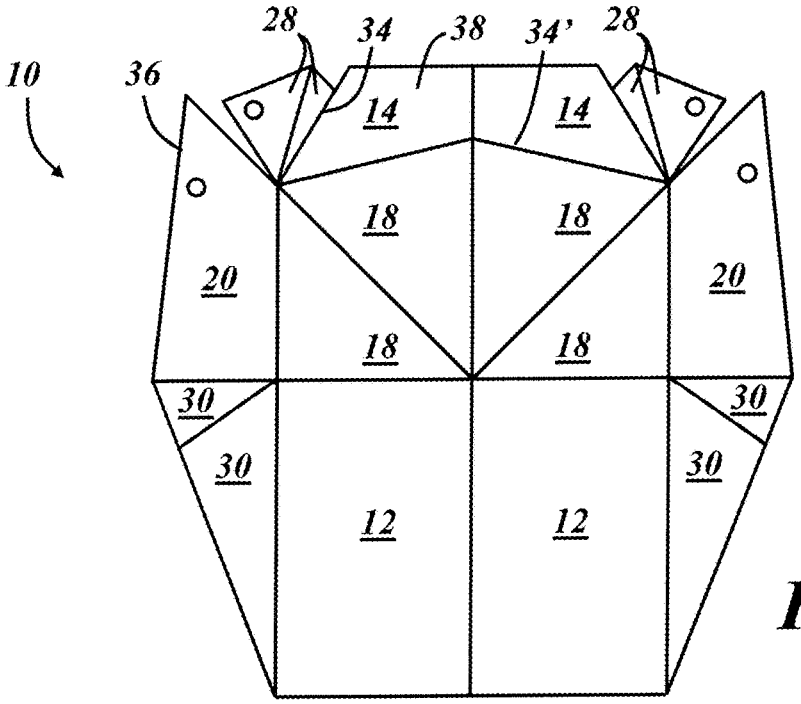
FIG. 4 is a plan view of a pattern for the portable armrest in an opened-flat configuration.

FIG. 4 is a plan view of the portable armrest 10 of FIGS. 2 and 3 in an opened-flat configuration, which may be referred to as a pattern for the armrest. As illustrated, the portable armrest 10 may be constructed as a segmented panel 36 having a plurality of flat segments 38 interconnected into a one-piece structure by a plurality of hinge joints 34. The illustrated pattern includes eighteen polygonal flat segments. Each one of the lines within the outer perimeter of the illustrated pattern represents a hinge joint 34 in FIG. 4. In some embodiments, the segmented panel 36 has a higher rigidity at the segments 38 than at the joints 34. For example, each individual segment 38 may be sufficiently rigid to support its own weight without bending when the flat planes are oriented horizontally, while the joints may be formed from a material with essentially zero resistance to bending. In some cases, only a portion of the segments 38 are more rigid than the joints 34.

Each segment 38 has a perimeter, and one of the hinge joints 34 connects each segment to an adjacent segment along the perimeter of the adjacent segment. In the illustrated example, each segment 38 is in the shape of a triangle or a quadrilateral, and each hinge joint 34 is a linear hinge joint that provides a single rotational degree of freedom of movement between the segments that it joins. Each of the lap portion 12, arm portion 14, support portion 16, and foldable connectors 28, 30 includes a plurality of segments 38 and at least one hinge joint 34. Each segment 38 is labeled in FIG. 4 with the portion of the armrest 10 to which it belongs, with the end wall 18 and sidewalls 20 of the support portion 16 labeled separately.

The lap portion 12 includes a pair of adjacent rectangular segments connected by a central hinge joint. The arm portion 14 includes a pair of adjacent quadrilateral segments connected by a central hinge joint. The end wall 18 of the support portion 16 includes four triangular segments, a pair of which are connected to the lap portion 12 by a hinge joint, and another pair of which are connected to the arm portion 14 by a hinge joint. The two pairs of triangular segments of the end wall 18 are connected to each other by diagonal hinge joints, and the pair of triangular segments of the end wall that are connected to the arm portion 14 are connected to each other by a hinge joint. Each side wall 20 includes only one quadrilateral segment and is connected to the end wall 18 by a respective hinge joint. Omission of a hinge joint in the side walls may offer greater arm load support without buckling. Each upper foldable connector 28 is connected to a respective segment of the arm portion 14. Each lower foldable connector 30 is connected to one of the side walls 20 and one of the segments of the lap portion 12. Each foldable connector 28, 30 includes respective pairs of triangular segments connected by hinge joints.

The segmented panel 36 is constructed such that some of the hinge joints 34 maintain a full rotational degree of freedom about an axis parallel with the linear joint, and some of the hinge joints have only a partial rotational degree of freedom. For example, the hinge joints connecting the side walls 20 to the end wall 18 provide 360 degrees of relative rotational movement between the end wall and the side walls. In other words, the side walls can be folded over onto the end wall in both directions—on top of the end wall or under the end wall when laid flat as in FIG. 4. The hinge joints 34' connecting the arm portion 14 to the end wall 18, on the other hand, have only a partial rotational degree of freedom about the joint, as do the diagonal joints connecting the triangular segments of the end wall 18. These restrictive hinge joints 34' have limited freedom of movement about the joint because they extend only partially across the pattern. Restrictive hinge joints 34' can be useful in the deployed configuration at locations where joint stability is desired, such as at the joint between the arm portion 14 and the end wall 18, which must bear some of the load of the arms of the seated user.

Figure 5A:
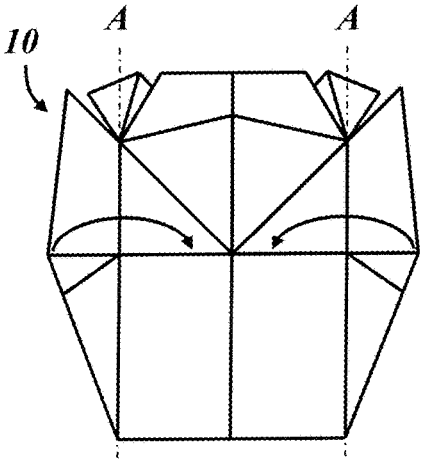
FIGS. 5A-5E illustrate the portable armrest of FIG. 4 in various stages of folding from the opened-flat configuration to a folded-flat configuration.
Figure 5B:
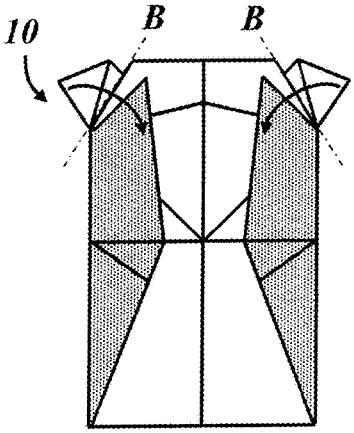

FIGS. 5A-5E illustrate the armrest 10 during conversion to the folded configuration from the opened-flat configuration of FIG. 4. In these figures, one planar side of the segmented panel is unshaded, and the opposite side is shaded. The shaded and unshaded sides correspond to the depiction in FIGS. 1-3, where the body-facing side of the deployed armrest is shaded. Some reference numerals are omitted in FIGS. 5A-5E as well, for clarity in illustration, but the reference numerals used in the following description can be found in FIG. 4. FIG. 5A illustrates the segmented panel of FIG. 4 in the opened-flat configuration with two folding axes (A) also illustrated. The side walls 20 and the lower foldable connectors 30 are folded inward about the axes (A) in the direction of the curved arrows over the lap portion 12 and the end wall 18 to reach the configuration of FIG. 5B. The upper foldable connectors 28 are then folded inward about folding axes (B) in the direction of the curved arrows over the arm portion 14 and the side walls 20 to reach the configuration of FIG. 5C. The end wall 18 is then folded about a folding axis (C) in the direction of the curved arrow over the lap portion 12 to reach the configuration of FIG. 5D. Finally, one segment of the lap portion 12 is folded over the other about a folding axis (D) to reach the folded configuration of FIG. 5E, in which the armrest is folded flat with all of the flat segments 38 arranged in a plurality of parallel planes with some of the segments overlapping each other. At least a portion of the folded-flat configuration includes eight overlapping layers of flat segments.

In the illustrated folded configuration, the armrest 10 is portable and occupies significantly less volumetric space than in the deployed configuration. Both the lateral width and the longitudinal length of the folded armrest are approximately one half of the respective width and length in the deployed configuration. The vertical height is decreased even more significantly from the deployed to the folded configuration and may be referred to as the thickness of the armrest in the folded configuration. For example, the thickness of the folded armrest may be only 10-20% of the height of the deployed armrest. In one non-limitimg example, the pattern of FIG. 4 has a length and a width of about 600 mm and a thickness of about 5 mm, resulting in a deployed configuration having dimensions of about 300×370×275 mm (L×W×H) and a folded configuration having corresponding dimensions of about 150×185×40 mm. Stated differently, the folded armrest would fit into a rectangular box occupying less than 5% of the volume of a box in which the deployed armrest would require to fit into.

The armrest 10 may include a closure (not illustrated) that engages to prevent the armrest from unfolding when in the folded configuration. One example of a closure is an elastic strap that wraps around the folded armrest when engaged and which can be selectively unwrapped or slid off of the folded armrest when a used wished to convert the armrest to the deployed configuration. Other non-limiting examples of closures include snaps, buckles, ties, zippers, buttons, hooks-and-loops, or magnets, to name a few. Such a closure may be attached to the segmented panel as part of the one-piece construction. In another embodiment, the length and width of the armrest in the folded configuration may be sized to accommodate the outer dimensions of a notebook or tablet computer. For instance, at least one segment of the lap portion may include an additional layer of material and a closure to form a closable storage compartment for such a device.

Figure 5C:
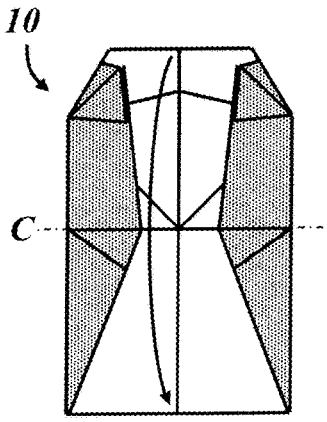
Figure 5D:
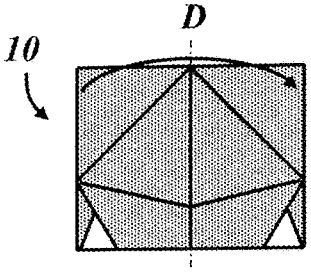
Figure 5E:
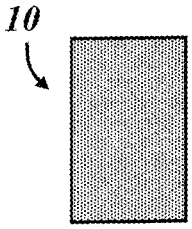
Figure 6A:
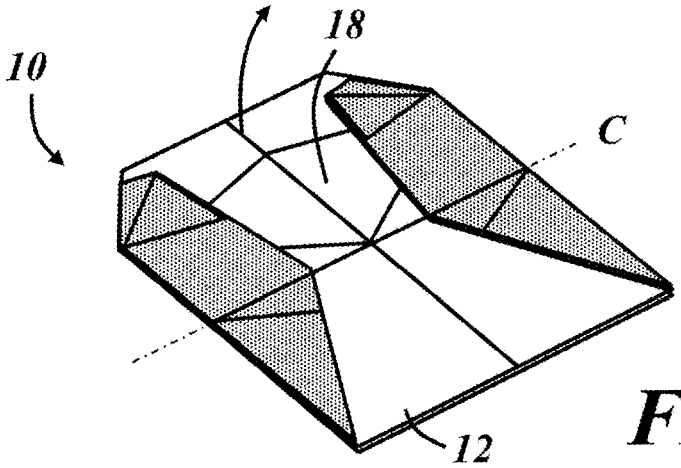
FIGS. 6A-6C illustrate the portable armrest of FIGS. 4-5E in various stages of folding from an intermediate configuration to the deployed configuration.
Figure 6B:
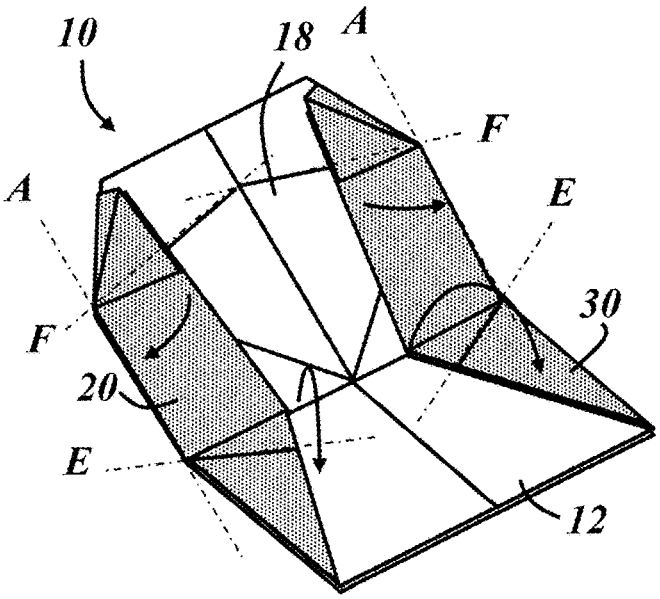
Figure 6C:
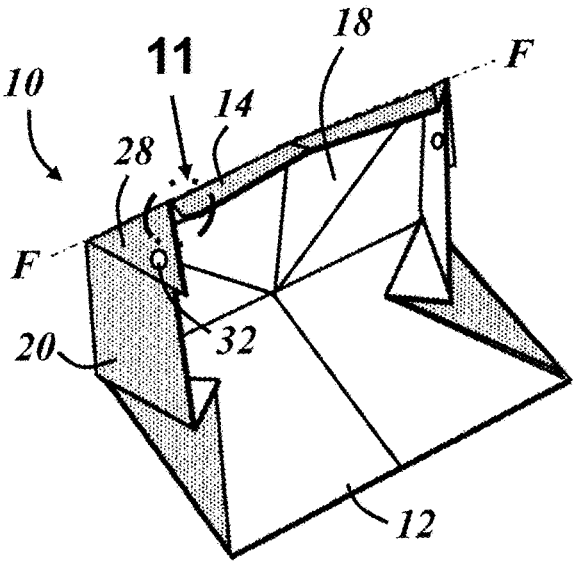

FIGS. 6A-6C illustrate the armrest 10 during conversion to the deployed configuration. From the folded configuration, the steps illustrated in FIGS. 5C-5E are first performed in reverse to reach the configuration of FIG. 6A, although it is not necessary to completely unfold the armrest about the folding axis (C) to the fully flat configuration of FIG. 6A. The end wall 18 is then partially folded about the folding axis (C) in the direction of the curved arrow of FIG. 6A so that the angle formed between the end wall 18 and the lap portion 12 is greater than 90 degrees to reach the configuration of FIG. 6B.

From the configuration of FIG. 6B, the armrest is unfolded along multiple folding axes (A) and (E). In particular, the segments of the lower foldable connectors 30 that are connected to the lap portion 12 (i.e., the large segments in this example) are kept flat against the lap portion while the other segments (i.e., the small segments in this example) of the foldable connectors 30 are folded about the folding axes (E) until the two segments of each foldable connector are flat against one another. This causes the side walls 20 to pivot about the folding axes (A) away from the end wall 18 such that, when the small segments of the foldable connectors 30 are brought flat against the large segments, the side walls are upright over the lap portion 12 and extending vertically away from the lap portion as in FIG. 6C. This forms the origami-like reverse folds described above. The simultaneous closing fold about the folding axes (E) and opening fold about the folding axes (A) also brings the end wall 18 to an upright orientation.

After the reverse folds are completed, the segments of the arm portion 14 are folded about folding axes (F) to reach the configuration of FIG. 6C in which the arm portion extends from the upper end of the end wall 18 in the same direction as the lap portion 12—i.e., away from the seated user. The degree of folding of the arm portion 14 about these axes (F) is limited by virtue of the restrictive hinge joints that lie therealong, as described above, which helps the arm portion support a load without collapsing. The small segments of the upper foldable connectors 28 fold along their respective hinge joints with the arm portion 14 in the opposite direction from the folded configuration of the armrest so that they extend upward from the lateral ends of the arm portion to the large segments of connectors 28, which extend downward along an exterior of the side walls 20 and can be attached to the side walls via fasteners 32 to complete deployment of the armrest 10. The segments of the arm portion 14 may be inclined with respect to the lap portion, at an angle greater than zero and less than 30 degrees, for example, with the exterior side of the arm portion 14 tilted toward the user or in the same direction as the body-facing side of the armrest.

Figure 7:
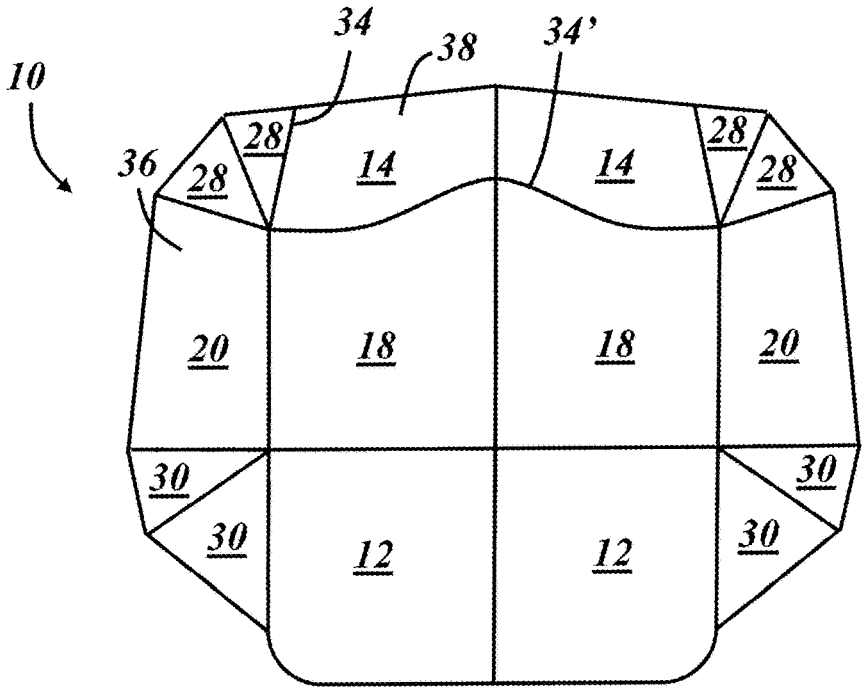
FIG. 7 is a plan view of another pattern for the portable armrest in an opened-flat configuration.

FIG. 7 is a plan view of another embodiment of the portable armrest 10 in the opened-flat configuration. The illustrated armrest 10 is again constructed as a segmented panel 36 having a plurality of flat segments 38 interconnected into a one-piece structure by hinge joints 34, each represented by lines within the outer perimeter of the pattern. Some of the hinge joints 34 are linear, and some are non-linear hinge joints 34', which is a form of restrictive hinge joint. Each of the lap portion 12, arm portion 14, support portion 16, and foldable connectors 28, 30 includes a plurality of segments 38 and at least one hinge joint 34. Each segment 38 is labeled in FIG. 7 with the portion of the armrest 10 to which it belongs, with the end wall 18 and sidewalls 20 of the support portion 16 labeled separately.

The lap portion 12 includes a pair of adjacent rectangular segments connected by a central hinge joint. One corner of each rectangular segment is rounded. The arm portion 14 includes a pair of adjacent four-sided segments connected by a central linear hinge joint. The end wall 18 of the support portion 16 includes a pair of adjacent four-sided segments connected by a central linear hinge joint. The arm portion 14 and end wall 18 are connected to each other by non-linear hinge joints 34'. Each side wall 20 includes only one quadrilateral segment and is connected to the end wall 18 by a respective hinge joint. Each upper foldable connector 28 includes a pair of triangular segments, one of which is connected to a segment of the arm portion 14 by a hinge joint, and another of which is connected to one of the side walls 20 by a hinge joint. The two triangular segments of each upper foldable portion are connected by a hinge joint as well. Each lower foldable connector 30 includes a pair of triangular segments connected by a hinge joint, a first of which is connected to one of the side walls 20 and a second of which is connected to a segment of the lap portion 12.

The non-linear hinge joints 34' have only a partial rotational degree of freedom about the joint, and the orientation of the folding axis associated with the non-linear hinge joints may change as the degree of folding changes. These restrictive hinge joints 34' have a freedom of movement that is more limited than in the corresponding restrictive hinge joints described in conjunction with FIG. 4 and can be useful in the deployed configuration where increased joint stability is desired, such as at load bearing joints.

Figure 8A:
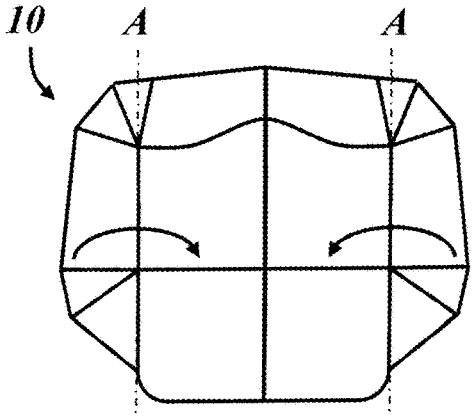
FIGS. 8A-8D illustrate the portable armrest of FIG. 7 in various stages of folding from the opened-flat configuration to a folded-flat configuration.
Figure 8B:
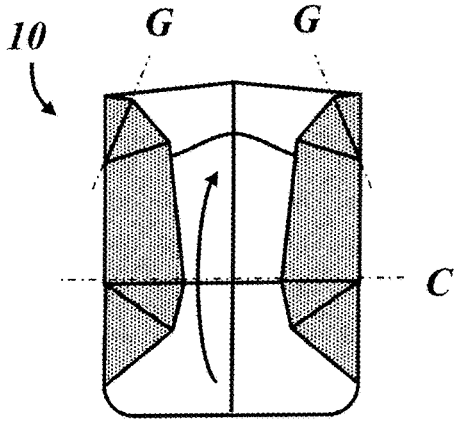
Figure 8C:
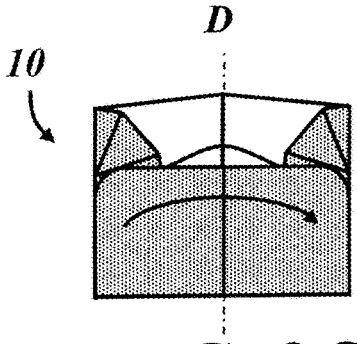
Figure 8D:
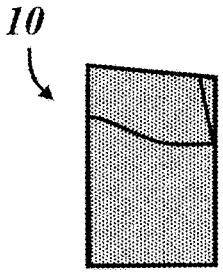

FIGS. 8A-8D illustrate the armrest 10 converted to the folded configuration from the opened-flat pattern of FIG. 7, with opposite sides of the segments shaded consistent with the previous figures. Some reference numerals are omitted for clarity in illustration, but the reference numerals of FIG. 7 are used in the following description. FIG. 8A illustrates the segmented panel of FIG. 7 in the opened-flat configuration with two folding axes (A). The side walls 20, the lower foldable connectors 30, and a portion of the upper foldable connectors 28 are folded inward about the axes (A) in the direction of the curved arrows over the lap portion 12, the end wall 18, and the arm portion 14 to reach the configuration of FIG. 8B. The triangular segments of the upper foldable connectors 28 through which the folding axes (A) run may be non-rigid segments as discussed further below. The lap portion 12 is then folded about the folding axis (C) in the direction of the curved arrow over the end wall 18 to reach the configuration of FIG. 8C. Finally, one segment of the lap portion 12 is folded over the other about the folding axis (D) to reach the folded configuration of FIG. 8D, in which the armrest is folded flat with all of the flat segments 38 arranged in a plurality of parallel planes with some of the segments overlapping each other. At least a portion of the folded-flat configuration includes eight overlapping layers of flat segments, and the armrest 10 may include a closure to prevent the armrest from unfolding, as described in conjunction with FIGS. 6A-6E.

In the illustrated folded configuration, the lateral width of the folded armrest is approximately one half of the width in the deployed configuration, and the length of the folded armrest is approximately two-thirds of the length of the deployed configuration. The vertical height is decreased more significantly, with the thickness of the folded armrest being be only 10-20% of the height of the deployed armrest. In one non-limiting example, the pattern of FIG. 7 has a width of about 600 mm, a length of about 500 mm, and a thickness of about 5 mm, resulting in a deployed configuration having dimensions of about 250×370×275 mm (L×W×H) and a folded configuration having corresponding dimensions of about 165×185×40 mm. Stated differently, the folded armrest would fit into a rectangular box occupying less than 5% of the volume of a box in which the deployed armrest would require to fit into.

Figure 9:
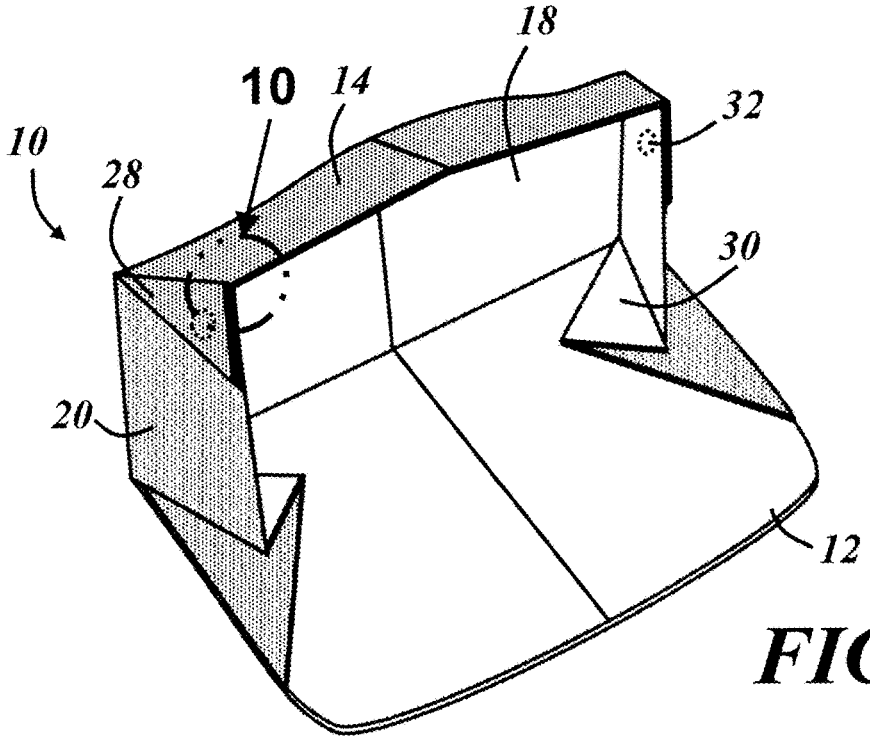
FIG. 9 illustrates the portable armrest of FIGS. 7-8D in the deployed configuration.

Conversion of the armrest 10 to the deployed configuration with the pattern of FIG. 7 is substantially identical to that described in conjunction with FIGS. 6A-6C, except for the final folds involving the upper foldable connectors 28. Starting with the configuration of FIG. 8B, the end wall 18 is folded upward about the folding axis (C) enough to allow the reverse fold to be formed in the lower foldable connectors 30, which brings the upright sidewalls 20 over the lap portion 12. Then the segments of the arm portion 14 are folded down about the non-linear hinge joint 34', and the upper foldable connectors 28 are folded along folding axes (G), along which the two triangular segments of each upper foldable connector 28 are joined (see FIG. 8B). This fold is analogous to an outside reverse fold in origami. The segment of the connector 28 adjacent the arm portion 14 ends up on the outside of the other segment of the connector 28 to arrive at the deployed configuration of FIG. 9, in which the illustrated fasteners 32 are magnetic and embedded in the segmented panel.

Figure 10:
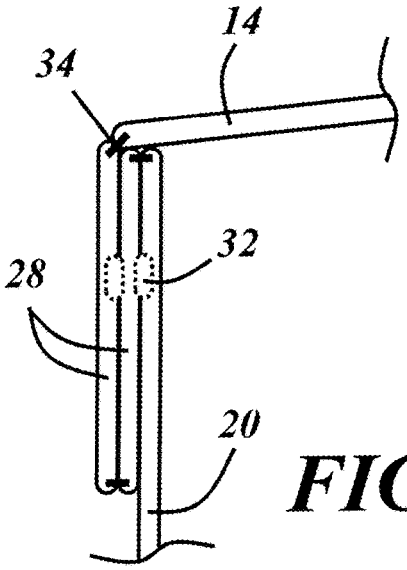
FIG. 10 is an enlarged schematic depiction of an upper foldable connector of the deployed armrest of FIG. 9.

There are therefore three overlapping segments at each lateral end of the arm portion 14 all interconnected by hinge joints, including both triangular segments of the upper foldable connector 28 and the respective sidewall 20. A view from the forward-facing side of the deployed armrest in FIG. 10 shows these folds in further detail. FIG. 10 is only a schematic representation in which the individual segments of the arm portion 14, the side wall 20, and the two segments of the upper foldable connector 28 are illustrated with respective hinge joints 34 shown as relatively short, thick line segments.

Figure 11:
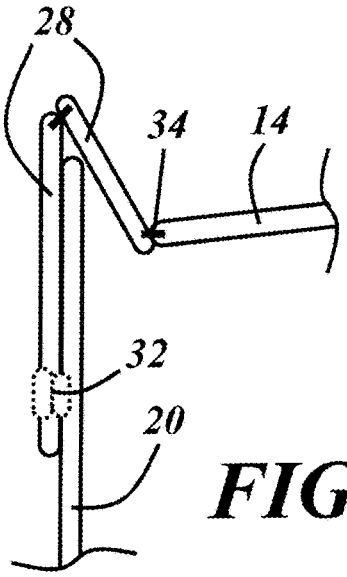
FIG. 11 is an enlarged schematic depiction of the upper foldable connector of the deployed armrest of FIG. 6C.

Similarly, FIG. 11 is a view from the forward-facing side of the deployed armrest of FIG. 6C schematically illustrating the corresponding folds associated with the upper foldable connectors 28 in further detail, where the upper end of the sidewall 20 is disposed between the two segments of the foldable connector 28.

Figure 12:
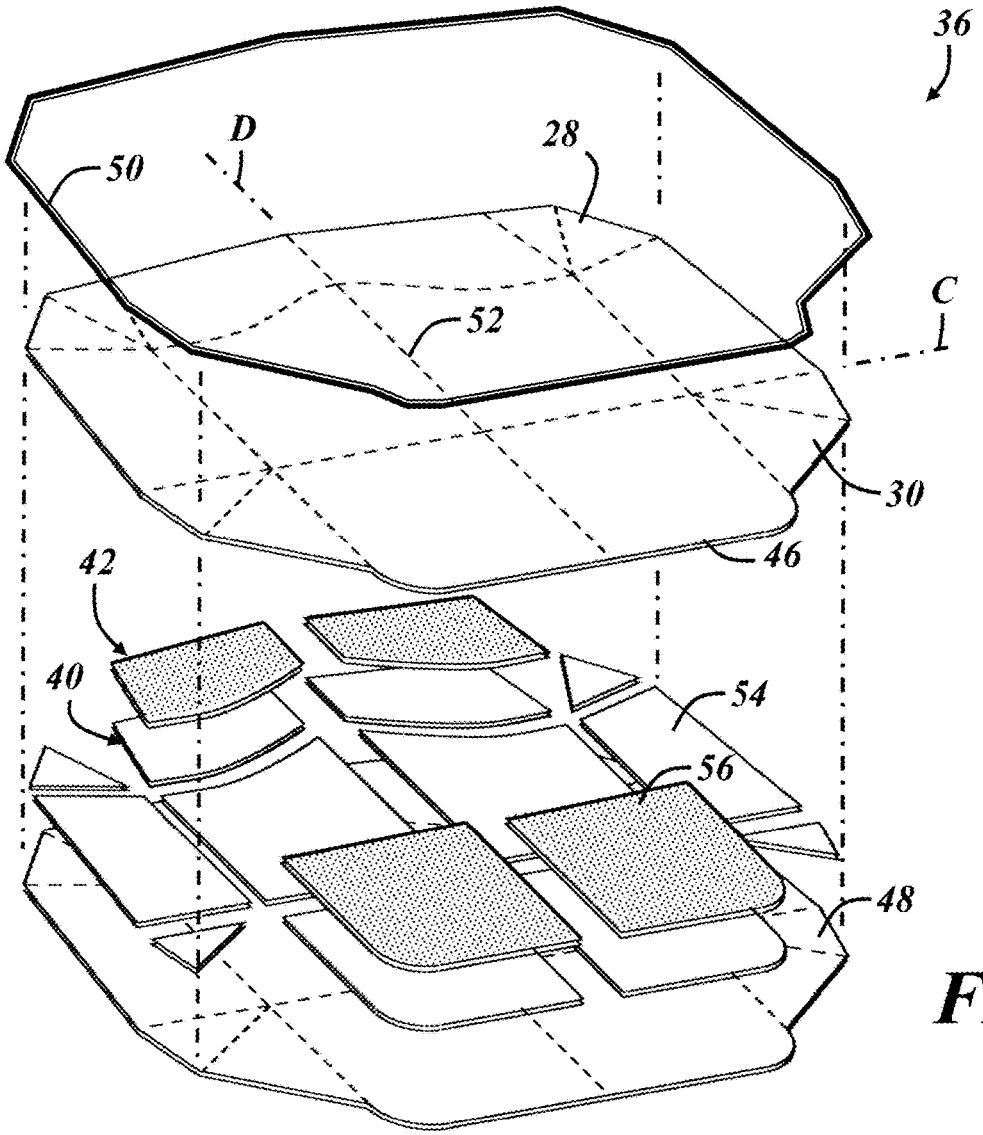
FIG. 12 is an exploded view of a segmented panel based on the pattern of FIG. 7, illustrating a segmented layer and a cushion layer between upholstery layers.

FIG. 12 is an exploded view depicting one manner of construction of the segmented panel 36 based on the pattern of FIG. 7, including a segmented layer 40 and a cushion layer 42 disposed between first and second upholstery layers 46, 48, as well as edge trim 50 and a plurality of lines of stitching 52. The panel 36 of FIG. 12 is inverted from that of FIG. 8A to better illustrate some of the layers. The segmented layer 40 includes a plurality of rigid plates 54, each of which fits within an individual segment 38 of the panel 36. The cushion layer 42 also includes a plurality of separate pieces 56, each of which is the same shape as an overlapping one of the rigid plates 54. An exemplary cross-sectional view of the segmented panel 36 is provided in FIG. 13.

Figure 13:
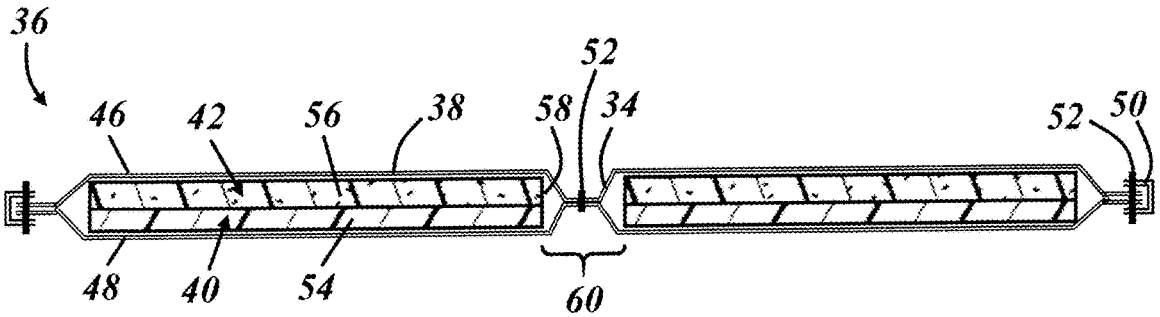
FIG. 13 is an exemplary cross-sectional view of a portion of a segmented panel.

The upholstery layers 46, 48 provide the visible outer surfaces of the segmented panel 36 and may have the flexible properties of a fabric i.e., it is foldable without plastic deformation of the upholstery material and has a negligible flexural modulus. Each upholstery layer may include or be a fabric layer woven, knit, or spun from synthetic and/or natural fibers, for example. Synthetic microfiber fabrics are one example of suitable upholster layer materials. Nearly any material can be used as the upholstery layers 46, 48 to provide a desired aesthetic and feel, so long as the material has a sufficiently low resistance to bending out of plane in the form of a hinge joint. In some embodiments, the upholstery layers have a thermoplastic component suitable to be laminated together to form the hinge joints 34 between adjacent segments 38 and plates 54, as shown in FIG. 13.

The rigid plates 54 of the segmented layer 40 are not foldable or bendable without plastically deforming the plate material and can be made from any suitable material exhibiting such properties, such as filled or unfilled polymeric materials, metals, or ceramics. The thickness of the plates also affects their rigidity, such that the plates can be made thinner from stiffer materials such as metals or polymer composites. An exemplary rigid plate 54 is a glass-filled thermoplastic material having a thickness between 2 mm and 4 mm. The rigid plates 54 are spaced apart from each other at fixed locations along and between the upholstery layers 46, 48. The plate locations can be fixed by lamination, an adhesive layer, stitching, or other suitable means. Each of the rigid plates 54 has an edge 58 that runs parallel with an edge of an adjacent rigid plate along a gap 60. The upholstery layers 46, 48 span the gap 60 to at least partly define the hinge joint 34 between the adjacent plates.

The spacing between adjacent plates 54 of the segmented layer 40 determines a width of the respective hinge joint 34. In some embodiments, the spacing between different pairs of adjacent plates 54 varies such that widths of the respective hinge joints are different. For example, the hinge joints 34 located along the parallel edges of the plates 54 lying along folding axes (C) and (D) may have a width that is greater than the width of other hinge joints of the segmented panel 36. Joint width may be defined in part by the number of interposed layers of segments 38 between the outermost layers when the armrest 10 is in the folded configuration. Hence, the hinge joints lying along folding axes (C) and (D) may be wider than other hinge joints in this example because the final two folds are formed along those joints. The hinge joint lying along the final folding axis, axis (D) in this example, may have the greatest width among the hinge joints. In one non-limiting example, the hinge joint 34 lying along the final folding axis (axis D in the illustrated examples) during conversion to the folded configuration has a width and a spacing between adjacent rigid plates of about 15 mm. The hinge joint 34 lying along the second to last folding axis (axis C in the examples) has a width and a spacing between adjacent rigid plates of about 10 mm, while the remaining hinge joints have a width of about 2 mm.

In some embodiments, not all segments 38 of the segmented panel include a rigid plate 54. In the illustrated example, rigid plates 38 are omitted from the segmented layer 40 along one of the two segments of each foldable connector 28, 30. Since the foldable connectors 28, 30 are folded back on themselves in the deployed configuration, this helps limit the thickness of the connectors 28, 30 when in the deployed configuration. Also, omission of the rigid plate can allow an individual segment of the foldable connectors to be folded in the folded configuration of the armrest, such as with the upper foldable connectors 28 discussed in conjunction with FIG. 8A. Rigid plates may be omitted from other portions of the segmented layer, although they are preferably included in the support portion 16, as well as in the lap portion 12 and the arm portion 14 for structural reasons.

The optional cushion layer 42 is a layer of foam or other suitable material located between one of the upholstery layers and the segmented layer 40. The cushion layer 42 is provided to help isolated the rigid plates 54 from the arms and legs of the user more than the upholstery layers 36, 38 can on their own and to provide a comfortable arm-resting surface. As such, pieces 56 of the cushion layer 42 are preferably located in the segments 38 corresponding to the lap portion 12 and the arm portion 14 of the armrest, although cushion layer pieces 56 can be included in other segments as well. In some embodiments, all of the rigid plates 54 have a piece 56 of the cushion layer 42 in an overlapping arrangement. The cushion layer 42 preferably does not span the hinge joints 42, as this would impart the hinge joints with excess thickness and an undesirable elastic quality.

The edge trim 50 may be provided along the outer perimeter of the opened-flat pattern to conceal the cut edges of the upholstery layers 36, 38 and/or enclose any rigid plates 54 between the upholstery layers where there is no hinge joint already doing so. The edge trim 50 may be attached via one of the lines of stitching 52, as shown in FIG. 13, or by other suitable means (e.g., adhesive, heat sealing, etc.).

The illustrated lines of stitching 52 may be decorative, functional, or both. In the example of FIG. 13, the line of stitching 52 located along the illustrated hinge joint 34 is primarily decorative, giving the appearance of a sewn hinge joint which is actually formed by lamination. But the stitching 52 is also a fail-safe for the hinge joint, in the event the upholstery layer delaminates at the joint 34. In the illustrated example, a line of stitching 52 is provided along every hinge joint 34 between every pair of adjacent segments 38. Lines of stitching may be additionally provided away from hinge joints, such as in the form of visual aids that help the user properly convert the armrest among its various configurations. In some embodiments, dual lines of stitching are provided along each hinge joint spaced apart in an amount of the desired joint width. Such lines of stitching can, for example, surround each of the plates 54 of the segmented layer and eliminate lamination and/or the need for additional attachment layers such as adhesive.

In one manner of making the armrest, the first and second upholstery layers 36, 38 are cut to the desired pattern shape, and the segmented and cushion layers 40, 42 stacked together and laminated between the upholstery layers. Then, the lines of stitching 52 are sewn along the hinge joints 34, and the edge trim is affixed along the perimeter of the pattern. A step of providing the segmented layer 40 and/or the cushion layer 42 may include die cutting each layer from sheet material. In one example, the segmented and cushion layers 40, 42 are die cut simultaneously from stacked layers of the desired materials into rigid plates 54 of the desired size and shape and cushion layer pieces 56 having shapes identical to the rigid plates. The reversible fasteners 32 may be added along the upholstery layer(s) prior to lamination.

Figure 14:
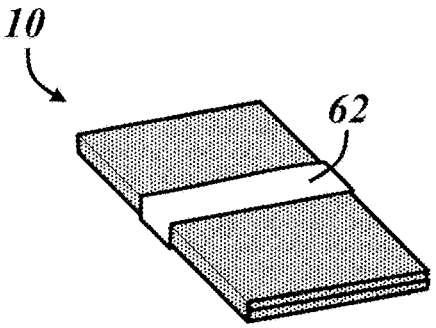
FIG. 14 depicts the portable armrest in the folded configuration, including an elastic closure.

FIGS. 14-19 illustrate various modifications of the portable armrest. FIG. 14 illustrates the portable armrest 10 in the folded configuration, as in FIG. 5E, as a stand-alone item with an elastic closure 62 that may remain attached to the armrest when in the deployed and the folded configurations.

Figure 15:
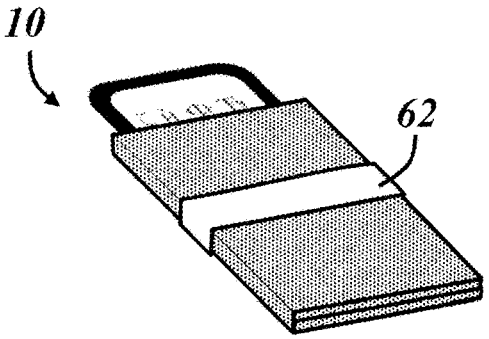
FIG. 15 depicts the portable armrest functioning as a sleeve for an electronic device.
Figure 16:
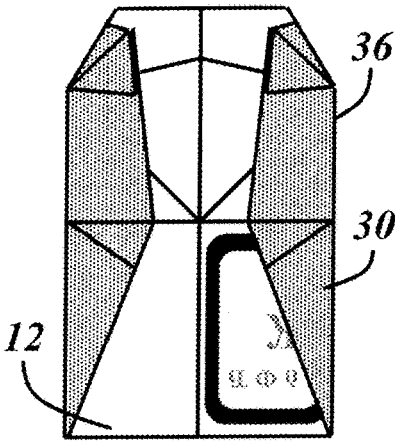
FIG. 16 illustrates a location of the electronic device of FIG. 15 relative to the segmented panel.

FIG. 15 illustrates the portable armrest 10 in a secondary function as a sleeve for a tablet or small notebook computer. The segmented panel may include one or more additional segments and/or layers of material specifically configured to receive and accommodate the tablet, or the tablet can simply be slid into an open end of the folded configuration so that it is surrounded on three of the four edges and both opposite faces. For example, the tablet can be slid between one of the foldable connectors 30 and a segment of the lap portion 12 during conversion to the folded configuration as shown in FIG. 16, or slid into the same location after conversion to the folded configuration.

Figure 17:
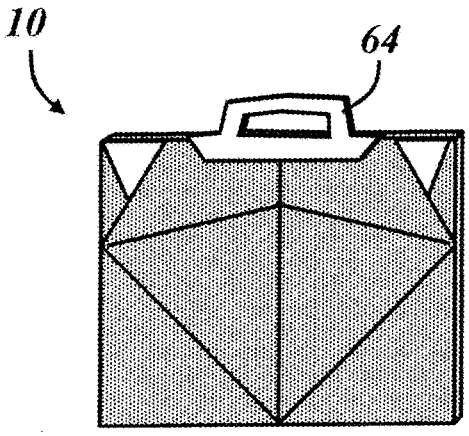
FIG. 17 depicts the portable armrest in a different folded configuration functioning as a handled carrier for a larger electronic device.
Figure 18:
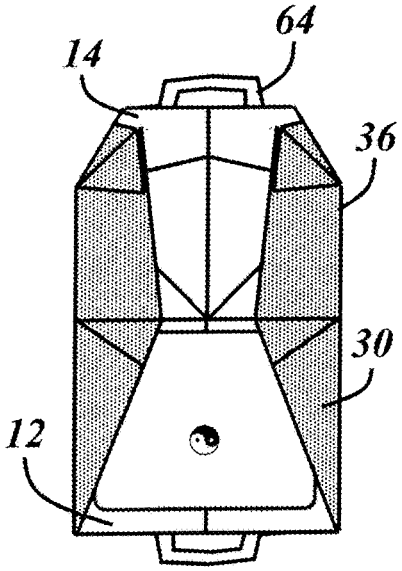
FIG. 18 illustrates a location of the electronic device of FIG. 17 relative to the segmented panel.

Similarly, FIG. 17 illustrates the portable armrest 10 in a secondary function as a sleeve or carrying case for a laptop computer. The folded configuration illustrated in FIG. 17 includes one less fold than that of FIG. 15 and corresponds to the configuration of FIG. 5D. The illustrated armrest 10 includes handles 64 attached to the segmented panel 36, in particular along edges of the lap portion 12 and arm portion 14. The segmented panel 36 may include one or more additional segments and/or layers of material specifically configured to receive and accommodate the computer, or the computer can be slid into an open end of the folded configuration near the handles 64 so that it is surrounded on three of the four edges and both opposite sides. For example, the laptop computer can be slid between the lap portion 12 and the lower foldable connectors 30 during conversion to the folded configuration as shown in FIG. 18, or slid into the same location after conversion to the folded configuration. Optionally, an additional closure may be provided to further secure the laptop computer between layers of the folded configuration.

Figure 19:
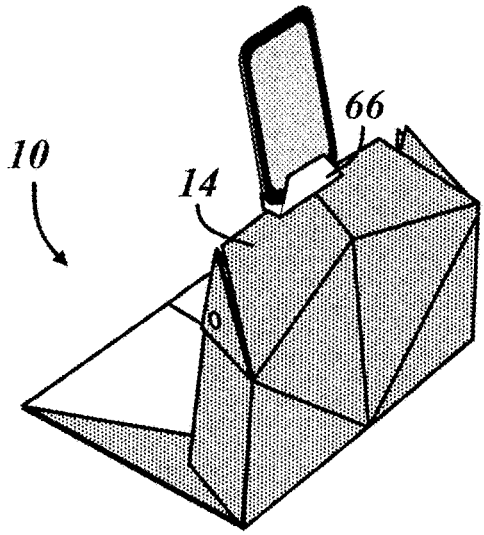
FIG. 19 illustrates the armrest of FIG. 3 with an attached device holder.

In FIG. 19, the armrest 10 includes an armrest accessory 66 configured to hold a mobile phone, tablet, or other similarly sized device. The illustrated accessory 66 extends from an edge of the arm portion 14 and may be an integrated and permanent part of the armrest 10, or it may be detachably fastened to the armrest via a clip or other temporary fastener. Non-limiting examples of armrest accessories, all of which provide some functionality other than resting the arms, include various holders, retainers, containers, and handles.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A portable armrest, comprising:

a lap portion, an arm portion, and a support portion that vertically spaces the arm portion from the lap portion when the lap portion is positioned on a lap of a seated user with the armrest in a deployed configuration such that a weight of an extended arm of the seated user is transferred to the lap when the extended arm is rested on the arm portion, the armrest further comprising a foldable connector connecting the lap portion to the support portion, the foldable connector being folded over on itself and on the lap portion in the deployed configuration, wherein the support portion includes an end wall and a pair of side walls, the end wall extending between an end of the lap portion and the arm portion, and the side walls extending from opposite ends of the end wall to form respective acute angles with the end wall in the deployed configuration, and wherein the armrest is manually convertible between the deployed configuration and a folded-flat configuration.

2. A portable armrest as defined in claim 1, further comprising a segmented panel comprising a plurality of flat segments interconnected by respective hinge joints.

3. A portable armrest as defined in claim 2, wherein the flat segments are arranged in a plurality of parallel planes and overlap each other in the folded-flat configuration.

4. A portable armrest as defined in claim 2, wherein at least one of the hinge joints is configured to provide substantially 360 degrees of relative movement about a folding axis between adjacent flat segments of the plurality of flat segments.

5. A portable armrest as defined in claim 2, wherein at least one of the hinge joints is non-linear so that relative movement between adjacent flat segments of the segmented panel about the non-linear joint is restricted to only a partial rotational degree of freedom.

6. A portable armrest as defined in claim 5, wherein the non-linear hinge joint connects the arm portion to the support portion.

7. A portable armrest as defined in claim 1, the foldable connector being flat in the folded-flat configuration.

8. A portable armrest as defined in claim 1, further comprising a foldable connector connecting the arm portion to the support portion, the foldable connector being folded over on itself in the deployed configuration.

9. A portable armrest as defined in claim 1, further comprising a foldable connector connecting the support portion to the arm portion or to the lap portion via one or more hinge joints, wherein the foldable connector includes a plurality of flat segments interconnected by additional hinge joints.

10. A portable armrest as defined in claim 9, wherein the foldable connector is folded in a first direction about one of the hinge joints in the deployed configuration and in an opposite second direction in the folded-flat configuration.

11. A portable armrest as defined in claim 1, further comprising a reversible fastener that engages to couple the arm portion with the support portion in the deployed configuration and is disengaged in the folded-flat configuration.

12. A portable armrest as defined in claim 1, further comprising an upholstery layer and a segmented layer, wherein the segmented layer comprises a plurality of plates spaced apart from each other at fixed locations along the upholstery layer, each of the plates having an edge that runs parallel with an edge of an adjacent plate along a gap with the upholstery layer spanning the gap to at least partly define a hinge joint between the adjacent plates.

13. A portable armrest as defined in claim 12, further comprising a plurality of hinge joints, each hinge joint being located between a respective pair of plates of the plurality of plates, wherein at least one hinge joint of the plurality of hinge joints has a width that is different from a width of another one of the hinge joints of the plurality of hinge joints.

14. A portable armrest as defined in claim 12, further comprising an additional upholstery layer, wherein the segmented layer is disposed between the upholstery layers and the hinge joint includes a portion of both upholstery layers.

15. A portable armrest as defined in claim 14, further comprising a cushion layer disposed between the segmented layer and one of the upholstery layers.

16. A portable armrest as defined in claim 15, wherein the cushion layer is segmented so that the cushion layer does not span the hinge joint.

17. A portable armrest as defined in claim 1, further comprising an armrest accessory extending from the arm portion when the portable armrest is in the deployed configuration.

18. A portable armrest, comprising:

a lap portion, an arm portion, and a support portion that vertically spaces the arm portion from the lap portion when the lap portion is positioned on a lap of a seated user with the armrest in a deployed configuration such that a weight of an extended arm of the seated user is transferred to the lap when the arm is rested on the extended arm portion, wherein the armrest is manually convertible between the deployed configuration and a folded configuration, the armrest further comprising a first foldable connector connecting the arm portion to the support portion, the first foldable connector being folded over on itself in the deployed configuration, and a second foldable connector connecting the lap portion to the support portion, the second foldable connector being folded over on itself and on the lap portion in the deployed configuration.

19. A portable armrest, comprising:

a lap portion, an arm portion, and a support portion that vertically spaces the arm portion from the lap portion when the lap portion is positioned on a lap of a seated user with the armrest in a deployed configuration such that a weight of an extended arm of the seated user is transferred to the lap when the extended arm is rested on the arm portion, wherein the armrest is manually convertible between the deployed configuration and a folded configuration, the armrest further comprising a reversible fastener and a foldable connector, wherein the reversible fastener engages to couple the arm portion with the support portion in the deployed configuration and is disengaged in the folded configuration, and wherein the foldable connector is folded over on itself and on the lap portion in the deployed configuration.

20. A portable armrest as defined in claim 19, further comprising a segmented panel comprising a plurality of flat segments interconnected by hinge joints.

* * * * *